US005154032A

United States Patent [19]

Ritter

[11] Patent Number: 5,154,032

[45] Date of Patent: Oct. 13, 1992

[54] BUILDING BLOCK SYSTEM

[75] Inventor: Karl Ritter, Hohberg, Fed. Rep. of Germany

[73] Assignee: Firma Hermann Uhl, Schutterwald, Fed. Rep. of Germany

[21] Appl. No.: 659,955

[22] Filed: Feb. 26, 1991

[51] Int. Cl.[5] ..... E04C 3/30

[52] U.S. Cl. ..... 52/593; 52/285; 52/596; 52/605; 52/608; 47/32; 405/284

[58] Field of Search ..... 52/596, 605, 606, 607, 52/608, 285, 71, 593, 587, 612; 405/284, 273, 262; 47/32, 33; D25/113-118; 256/19, 24, 1, 27

[56] References Cited

U.S. PATENT DOCUMENTS

| | | | |
|---|---|---|---|
| 2,126,011 | 8/1938 | Hedinger | 52/606 X |
| 3,102,367 | 9/1957 | Pederson et al. | D25/114 X |
| 3,247,633 | 7/1964 | Schultz et al. | 52/606 |
| 3,537,687 | 11/1970 | Adelman | 256/24 X |
| 3,726,042 | 4/1973 | Haile | 256/19 X |
| 4,719,735 | 1/1988 | Fleming et al. | D25/113 X |
| 4,787,189 | 11/1988 | Haug et al. | 52/606 X |
| 4,802,318 | 2/1989 | Snitovski | 52/612 X |
| 4,982,535 | 1/1991 | Pickett | 256/26 X |

FOREIGN PATENT DOCUMENTS 1402992 2/1984 United Kingdom .

*Primary Examiner*—David A. Scherbel
*Assistant Examiner*—Kien Nguyen
*Attorney, Agent, or Firm*—Spencer, Frank & Schneider

[57] ABSTRACT

A mortarless building block system employs primary blocks with projection on the top sides and recesses on the bottom sides to lock different courses of primary blocks together in a wall. The primary blocks in one course are rotated by 180° with respect to the primary blocks in the next course. Each primary block has a generally rectangular main portion and a bulbous portion of the same width as the main portion. The bulbous portion is joined to the main portion at one end thereof, and the other end of the main portion has a concave socket region which receives the bulbous portion of another primary block. The bulbous portion may be shaped as an incomplete regular dodecagon (12-sided polygon), irregular polygon, or cylinder. In addition to the primary blocks, the building block system includes covers for the top course of primary blocks and auxiliary blocks corresponding to the bulbous portions of the primary blocks.

20 Claims, 5 Drawing Sheets

BUILDING BLOCK SYSTEM

BACKGROUND OF THE INVENTION

The present invention relates to a building block system, particularly for the creation of separating walls, supporting walls, borders, and the like in gardens and parks.

In prior art building block systems of this type, the elements are put together without mortar. They engage one another by means of certain projections to hold the blocks together better and to simplify the laying of the blocks. For example, complementary projections and recesses may be provided at the upper and lower horizontal sides and/or at the lateral sides.

However, difficulties arise if the wall is to follow a bent course involving an angle of less than 90°. In such a case, the wall cohesion normally resulting from the fact that the blocks of one course are offset longitudinally relative to the blocks of the adjacent courses is broken. Two wall sections standing at an angle to one another thus cannot be connected with one another unless special angle blocks are provided for the individual angle sizes.

British Patent 1,402,922 discloses a "keyhole" shaped building block which incorporates a bulbous, rounded portion and an essentially rectangular main portion having a concave socket region at one end to receive the bulbous portion of an adjacent block. This configuration permits the erection of a curved or arbitrarily angled wall as a continuous interconnected unit. However, this prior art building block is too small for landscaping applications and, if it were made suitably larger, it would not have sufficient stability since the width of the essentially rectangular main portion is significantly less than the diameter of the bulbous, rounded portion. The term "width" is here intended to mean the dimension perpendicular to the vertical sides of the blocks, a dimension which corresponds to the thickness of the wall.

SUMMARY OF THE INVENTION

It is an object of the invention to provide a building block system for landscaping applications which is easily adapted to different requirements and whose elements are easily manipulated.

It is another object of the invention to provide a building block system with which a wall can be created that is bent at an angle, with the wall having a broad base, a continuously uniform thickness, and good connection between the blocks at the angular bend.

It is a further object of the invention to provide preplanned angles in the wall during laying of the blocks without measurements being required, simply by counting polygonal sides of the bulbous portions.

It is yet another object of the invention to provide a building block in which the rectangular main portion and the bulbous portion have the same width, and in which the main portion has two recessed or sloping faces at one end by which the main portion merges with the bulbous portion and two corresponding recessed faces at the other end leading to a concave socket region which has a reduced width. In this way, a wall can be created which has the same width throughout and which has a broad base with the corresponding high stability, with the wall being interrupted only by vertical notches at the transitions between the blocks.

With large format blocks, the rectangular main portion may be provided with chambers that are continuous from the top side to the bottom side, thus reducing the weight of the block and facilitating transport as well as work. Preferably, the top and bottom sides of the blocks are provided with complementary recesses and projections at the resulting transverse walls, which bound the chambers.

By turning the blocks about a common vertical axis through their bulbous portions when building a wall, the wall can be given an angle while simultaneously producing a connection. At the end of the wall, a bulbous portion is absent in every other course. Therefore, the system includes bulbous auxiliary blocks as components which complete the columnar shape at the end of the wall.

For planning and building it is of advantage for the bulbous portion to have the basic outline of a regular polygon, particularly a dodecagon. The desired angle in the wall can then be selected within a given angular graduation of, in this embodiment, 30°. If smaller angles are desired, an ellipse-like polygon whose long axis is perpendicular to the vertical sides of the block can be used as the basic outline of the bulbous portion.

In order to cover the chambers in the blocks for safety reasons and to prevent debris from entering, the building block system preferably includes covers which correspond in their outlines to the outlines of the blocks and which are provided with recesses at their undersides to accommodate the projections at the top of the wall.

DESCRIPTION OF THE PREFERRED EMBODIMENTS

Figure 1:
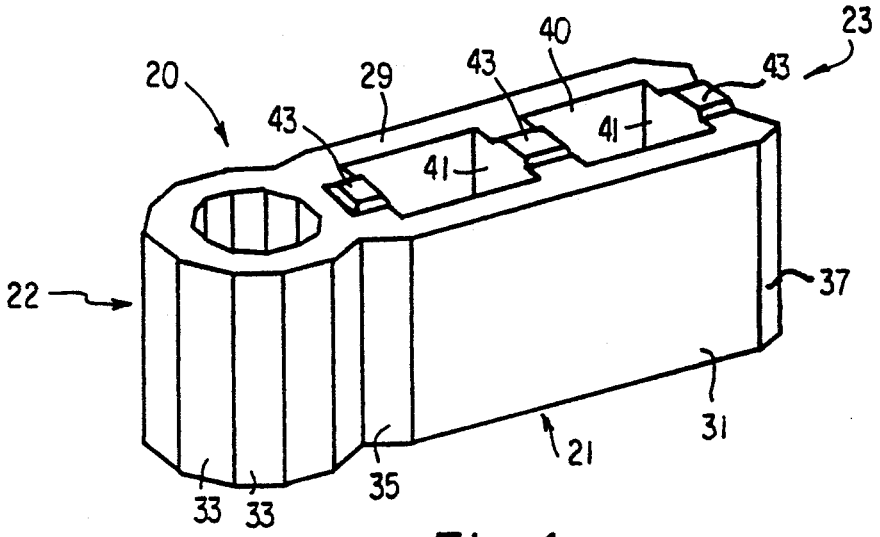
FIG. 1 is a perspective view of a primary block in a first embodiment of a building block system in accordance with the invention, the primary block having a bulbous portion.
Figure 2:
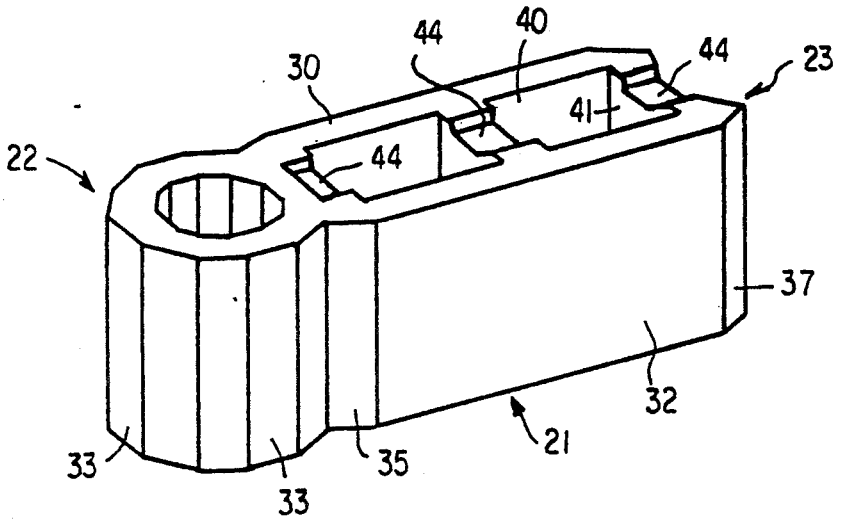
FIG. 2 is a perspective view of the primary block of FIG. 1, and shows the bottom side rather than the top side as in FIG. 1.
Figure 3:
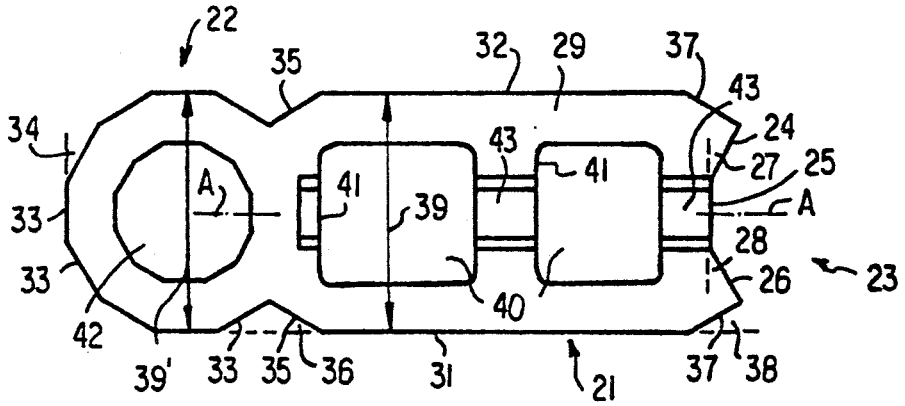
FIG. 3 is a top view of the primary block of FIG. 1.

With reference to FIGS. 1-3, the primary block 20 in a first embodiment of a building block system includes a generally rectangular main portion 21 and a bulbous portion 22 at one end of main portion 21. A concave socket region 23 is provided at the other end. Socket region 23 has three strip-shaped faces 24, 25, and 26. Face 25 is perpendicular to the longitudinal axis A of main portion 21, which also serves as the longitudinal axis of block 20 itself. Face 24 is disposed at an angle 27 of 30° with respect to face 25 and, similarly, face 26 is disposed at an angle 28 of 30° with respect to face 25. Main portion 21 has horizontal (top and bottom) sides 29 and 30 and vertical sides 31 and 32.

The basic shape of the exterior of bulbous portion 22 is a regular dodecagon, of which, however, only nine strip-like faces 33 actually exist. Faces 33 have the same width as faces 24-26. The angle 34 between adjacent faces 33 is 30°. By way of the remaining three (imaginary) faces of the dodecagon, bulbous portion 22 is connected to main portion 21. The vertical sides 31 and 32 of main portion 21 merge into bulbous portion 22 by way of sloping or recessed faces 35, which form an angle 36 of 30° with the respective vertical face and hence with longitudinal axis A. It will be apparent from FIG. 3 that the narrowed regions or notches where main portion 21 merges with bulbous portion 22 form isosceles triangles having 30° base angles, with one leg of each isosceles triangle being provided by a recessed face 35 and the other leg being provided by the adjacent face 33. At the other end of main portion 21, sloping or recessed faces 37 lead to the entrance of socket region 23. Like recessed faces 35, recessed faces 37 are disposed at a 30° angle (marked by reference number 38) with respect to vertical sides 31 and 32, and hence with respect to longitudinal axis A.

As will be seen in FIG. 3, the width of main portion 21, taken along a line 39 perpendicular to the vertical sides 31 and 32, is the same as the maximum width of bulbous portion 22, taken along a line 39' parallel to line 39.

The rectangular portion 21 includes two chambers 40 which are continuous from the top to the bottom. The chambers 40 are bounded, in the longitudinal direction of main portion 21, by three transverse webs 41. The bulbous portion 22 includes a dodecagon central chamber 42. Trapezoidal projections 43 are disposed at the upper side 29 of main portion 21, on the transverse webs 41, and corresponding trapezoidal recesses 44 are disposed at the underside.

Figure 4:
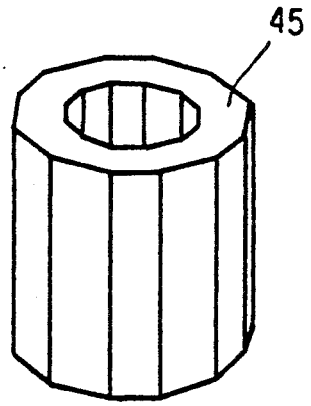
FIG. 4 is a perspective view of an auxiliary block for the first embodiment of a block system.
Figure 5:
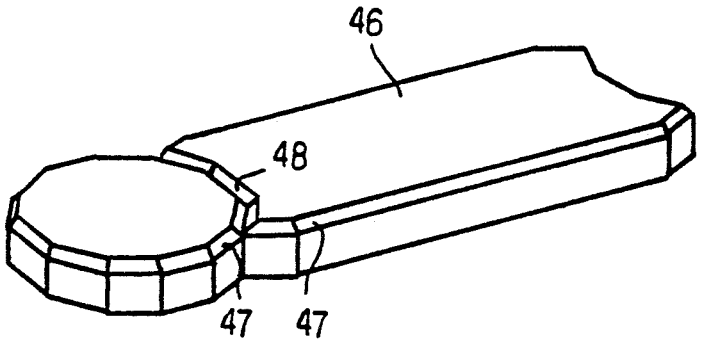
FIG. 5 is a perspective view of a cover for the first embodiment of the building block system.
Figure 6:
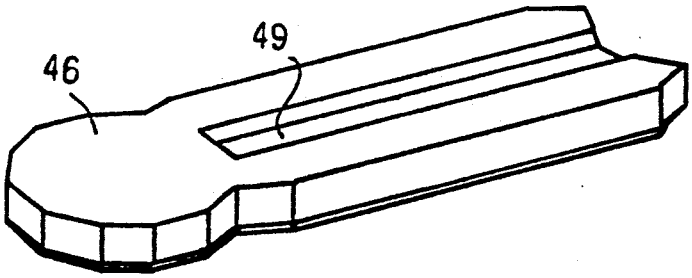
FIG. 6 is a perspective view showing the bottom of the cover of FIG. 5.
Figure 7:
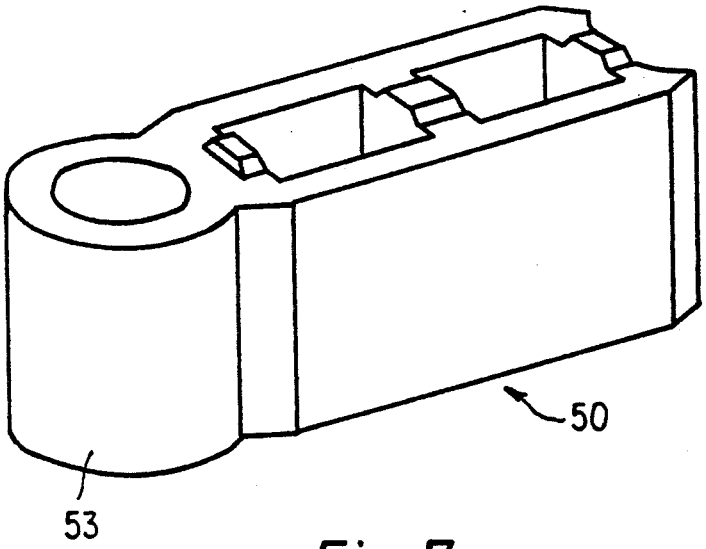
FIG. 7 is a perspective view of a primary block in a second embodiment of the building block system, the primary block having a circular bulbous portion.
Figure 8:
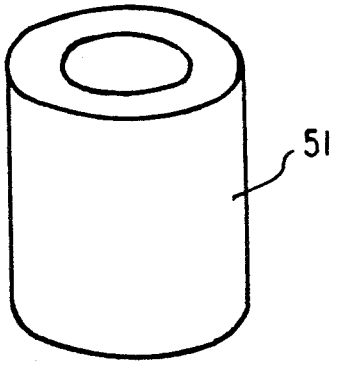
FIG. 8 is a perspective view of an auxiliary block for the second embodiment of the building block system.
Figure 9:
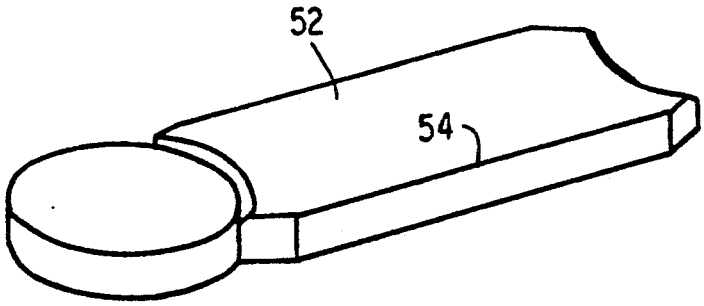
FIG. 9 is a perspective view of a cover for the second embodiment of the building block system.

The auxiliary block 45 according to FIG. 4 corresponds in shape to bulbous portion 22, after completion of the regular dodecagon at the region where bulbous portion 21 joins main portion 22. The cover 46 according to FIGS. 5 and 6 has the same basic outline as primary building block 20. The upper corners are beveled at 47. The dodecagonal portion of the surface is separated from the remainder of the surface by a triangular notch 48. At its underside, the cover 46 is provided with a longitudinal groove 49 which has a trapezoidal cross section suitable to accommodate projections 43.

Figure 10:
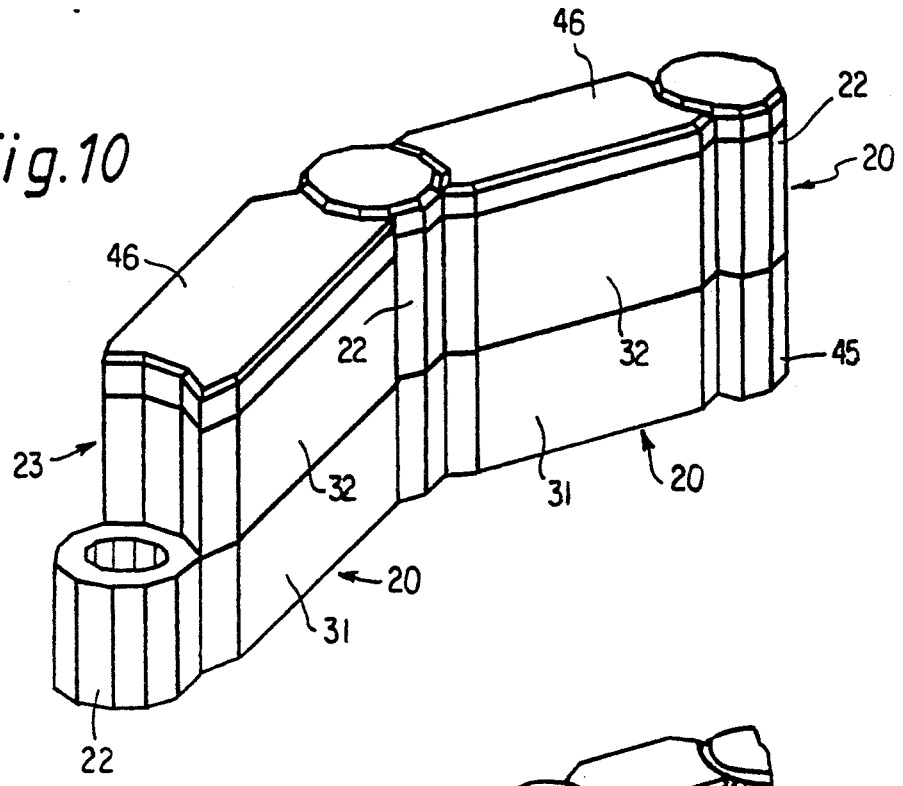
FIG. 10 is a perspective view of two courses of a wall topped by covers in accordance with the first embodiment of the building block system, the wall being angled.
Figure 11:
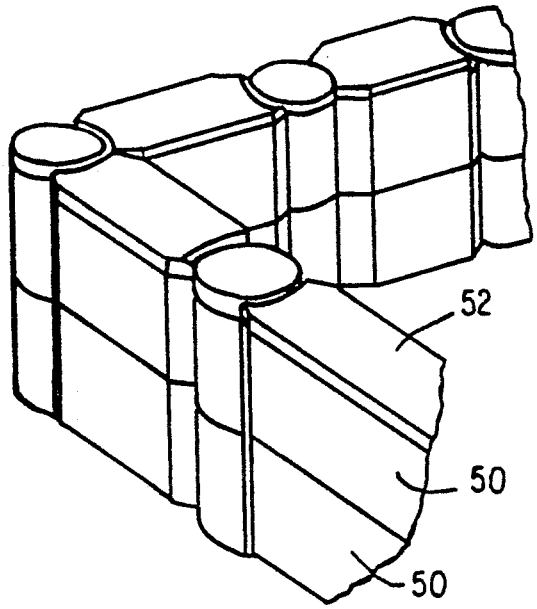
FIG. 11 is a perspective view of two courses of a wall topped by covers in accordance with the second embodiment of the building block system, the wall being angled.

FIG. 10 shows a portion of a supporting wall assembled from the components of a building block system according to the first embodiment of the invention. If the primary blocks 20 are placed in a row longitudinally, the dodecagon exterior shape of a bulbous portion 22 fits into the socket region 23 of the adjacent block 20, with the three strip-shaped faces 24-26 of the socket region 23 lying against three of the strip-like faces 33 of the bulbous portion. It is possible to place two primary blocks 20 against one another not only in a straight line, but also at angles of 30°, 60°, 90° on either side of a straight line. Except for 90° bends in a wall, the recessed faces 37 (see FIG. 3) leading toward the socket region 23 of one block 20, in conjunction with a face 33 (see FIG. 3) of the next block 20, will form a notch shaped as an isosceles triangle with 30° base angles. As was noted above, identical notches are provided where the portions 21 and 22 of a block 20 are joined, which leads to an aesthetically appealing symmetry at both ends of the main portions 21 of the blocks 20. The top course of blocks 20 shown in FIG. 10 is capped by covers 46. The second course shown in the FIG. includes an auxiliary block 45 beneath the bulbous portion 22 of the terminal block 20 in the top course. It should be noted that the primary blocks 20 of the second course are rotated by 180° with respect to the primary blocks 20 of the top course. This produces an interconnection which continues beyond the bend in the wall. If necessary for the sake of strength, chambers 40 or 42 (see FIG. 3) may be filled with concrete.

A building block system in accordance with a second embodiment of the invention is shown in FIGS. 7-9 and 11. The second embodiment includes primary blocks 50, auxiliary blocks 51, and covers 52. The components of the second embodiment differ from those of the first in that the bulbous portion 53 of block 50 is cylindrical, as is auxiliary block 51. Furthermore the edges 54 of cover 52 are not beveled.

Figure 12:
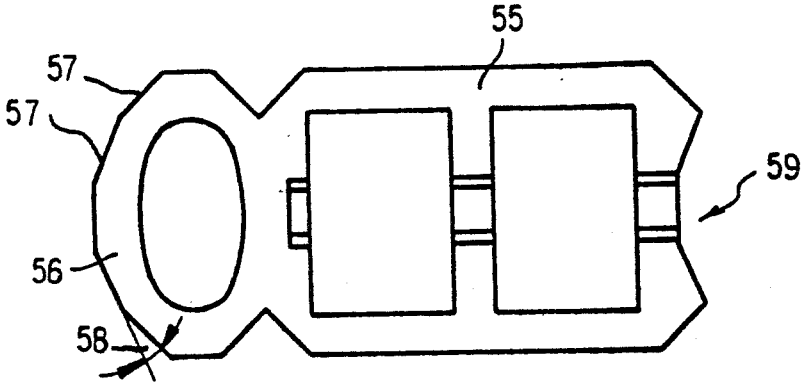
FIG. 12 is a top view of a primary block of a third embodiment of the building block system, in which the basic shape of the bulbous portion is an oval polygon.

The primary block 55 according to FIG. 12 is wider than primary block 20 (see FIGS. 1-3), and the bulbous portion 56 is an oval-shaped polygon. Although it also is basically a dodecagon, the angles are not all identical and some of the strip-like faces 57 are narrower. However, the five faces 57 at the forward end of the bulbous portion 56 have the same width and the same slope angle 58 of 22.5°. The socket region 59 at the other end of the generally rectangular portion is shaped correspondingly. Thus, these blocks 55 can be placed next to one another to the right or left, either in a straight line or at a slope angle of 22.5°.

Figure 13:
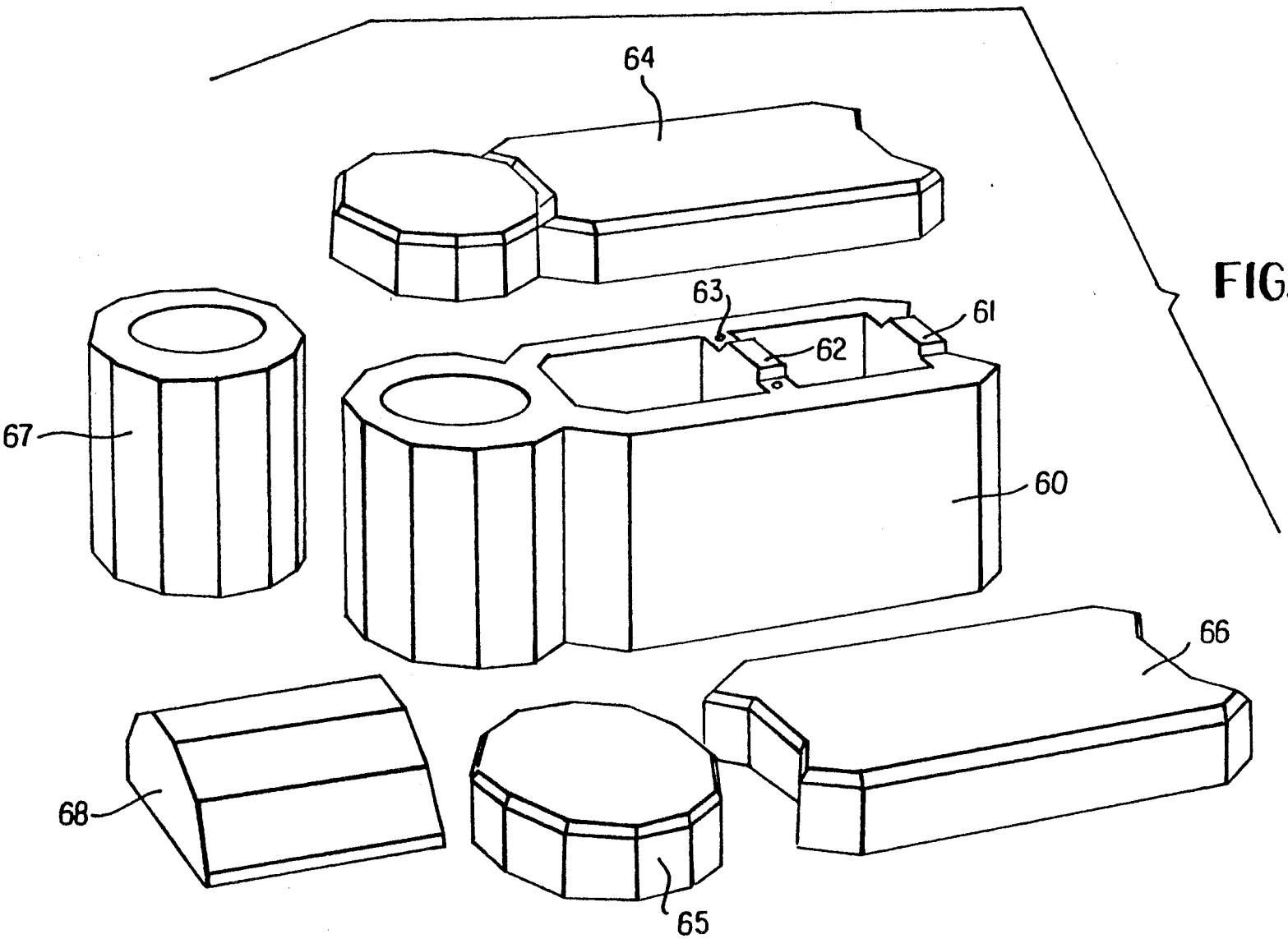
FIG. 13 is an exploded perspective view illustrating components in a modification of the first embodiment of the building block system.

FIG. 13 illustrates a building block system which, although employing a basically dodecagon bulbous portion, differs somewhat from the embodiment shown in FIGS. 1-3. For example, the primary block 60 has just two projections 61 and 62 on its upper side, and holes 63 are provided on either side of projection 62. Furthermore, in addition to a one-piece cover 64, the system includes individual cover portions 65 and 66. There are also two auxiliary blocks 67 and 68 in the system. Cover portions 65 and 66 can be used in lieu of or intermixed with covers 64 to cap the top course of a wall formed by interlocked primary blocks 60, or a single cover portion 65 can be used with covers 64 to cap an auxiliary block 67 or an otherwise-uncovered bulbous portion in the top course. Furthermore a path which is visually compatible with a nearby wall can be made by depositing either portions 65 or portions 66 on the ground as stepping stones. Auxiliary block 68 is not hollow like auxiliary block 67, and instead resembles a solid dodecagon which has been bisected parallel to its axis. This provides a major flat surface that can be abutted against a brick wall or so forth if the building block system of the invention is to be used for a wall extending from the brick wall.

Primary block 60 is 70 cm long, 24 cm wide, 25 cm high, and weighs 49 kg. Cover 64 is 70 cm long, 24 cm wide, 8 cm high, and weighs 28 kg. Auxiliary block 67 is 24 cm long, 24 cm wide, 25 cm high, and weighs 15 kg. Auxiliary block 68 is 11.5 cm long, 24 cm wide, 25 cm high, and weighs 10 kg. Cover portion 65 is 24 cm long, 24 cm wide, 8 cm high, and weighs 8 kg. Finally, cover portion 66 is 45 cm long, 24 cm wide, 8 cm high, and weighs 20 kg.

It will be understood that the above description of the present invention is susceptible to various modifications, changes, and adaptations, and the same are intended to be comprehended within the meaning and range of equivalents of the appended claims.

What is claimed is:

1. In a building block system which includes a primary building block having a generally rectangular main portion with a pair of vertical sides, a pair of horizontal sides, and first and second ends, the primary building block additionally having a bulbous portion connected to the first end of the main portion, the second end of the main portion having a concave socket region to receive a bulbous portion of an adjacent primary building block and one of the horizontal sides of the main portion having at least one projection while the other horizontal side has at least one complementary recess, the improvement wherein:

the width of the main portion, taken along a first line which is perpendicular to the vertical sides, is the same as the maximum width of the bulbous portion, taken along a second line which is parallel to the first line;

the vertical sides of the main portion have recessed faces adjacent the first end, where the main portion merges into the bulbous portion, and corresponding recessed faces adjacent the second end, leading toward the concave socket region; and the building block system further comprises a cover with an outline corresponding to that of the primary building block, the cover having a bottom side with a recess to accommodate the at least one projection of the main portion.

2. The building block system of claim 1, wherein the main portion has chambers which extend from one horizontal side of the main portion to the other horizontal side, the chambers defining transverse walls between the vertical sides of the main portion, and wherein the at least one projection and at least one complementary recessed are disposed on the transverse walls.

3. The building block system of claim 1, wherein part of the periphery of the bulbous portion is shaped as an ellipse-like polygon having a major axis that follows said second line.

4. The building block system of claim 1, further comprising an auxiliary block having a shape which conforms to that of the bulbous portion, without the main portion.

5. The building block system of claim 4, wherein the auxiliary block has the shape of a regular dodecagon, and further comprising another auxiliary block shaped as a portion of a dodecagon which has been split along a plane parallel to the axis of the dodecagon.

6. The building block system of claim 4, further comprising a cover portion with an outline corresponding to that of the main portion of the primary building block, and a cover portion with an outline corresponding to that of the auxiliary block.

7. In a building block system which includes a primary building block having a generally rectangular main portion with a pair of vertical sides, a pair of horizontal sides, and first and second ends, the primary building block additionally having a bulbous portion connected to the first end of the main portion, the second end of the main portion having a concave socket region to receive a bulbous portion of an adjacent primary building block and one of the horizontal sides of the main portion having at least one projection while the other horizontal side has at least one complementary recess, the improvement wherein:

the width of the main portion, taken along a first line which is perpendicular to the vertical sides, is the same as the maximum width of the bulbous portion, taken along a second line which is parallel to the first line;

the vertical sides of the main portion have recessed faces adjacent the first end, where the main portion merges into the bulbous portion, and corresponding recessed faces adjacent the second end, leading toward the concave socket region; and the building block system further comprises an auxiliary block having a shape which conforms to that of the bulbous portion, without the main portion.

8. The building block system of claim 7, wherein part of the periphery of the bulbous portion is shaped as regular dodecagon.

9. The building block system of claim 7, wherein the auxiliary block has the shape of a regular dodecagon, and further comprising another auxiliary block shaped as a portion of a dodecagon which has been split along a plane parallel to the axis of the dodecagon.

10. The building block system of claim 7, further comprising a cover portion with an outline corresponding to that of the main portion of the primary building block, and a cover portion with an outline corresponding to that of the auxiliary block.

11. In a building block system which includes a primary building block having a generally rectangular main portion with a pair of vertical sides, a pair of horizontal sides, first and second ends, and a longitudinal axis running through the ends, the primary building block additionally having a bulbous portion connected to the first end of the main portion, the second end of the main portion additionally having a concave socket region to receive a bulbous portion of an adjacent primary building block and one of the horizontal sides of the main portion having at least one projection while the other horizontal side has at least one complementary recess, the improvement wherein:

the outer periphery of the bulbous portion has nine faces that are arranged as three-fourths of the periphery of a regular dodecagon, one of the nine faces being more distant from the main portion of the primary block than the rest of the nine faces and being perpendicular to its longitudinal axis;

the vertical sides of the main portion have recessed faces adjacent the first end, where the main portion merges into the bulbous portion, the recessed faces having the same width as the faces of the bulbous portion and being disposed at a 30° angle relative to the longitudinal axis;

the vertical sides of the main portion have additional recessed faces adjacent to the second end, leading to the socket region, the additional recessed faces having the same width as the faces of the bulbous portion and being disposed at a 30° angle relative to the longitudinal axis;

the socket region has a central face which is perpendicular to the longitudinal axis and two side faces, each disosed at a 30° angle with respect to the central face, the faces of the socket region having the same width as the faces of the bulbous portion;

the width of the main portion, taken along a first line which is perpendicular to the vertical sides, is the same as the maximum width of the bulbous portion, taken along a second line which is parallel to the first line; and the building block system further comprises a cover with an outline corresponding to that of the primary building block, the cover having a bottom side with a recess to accommodate the at least one projection of the main portion.

12. The building block system of claim 11, wherein the main portion has chambers which extend from one horizontal side of the main portion to the other horizontal side, the chambers defining transverse walls between the vertical sides of the main portion, and wherein the at least one projection and at least one complementary recess are disposed on the transverse walls.

13. The building block system of claim 11, further comprising a cover portion with an outline corresponding to that of the main portion of the primary building block, and a cover portion shaped as a regular dodecagon.

14. The building block system of claim 13, further comprising an auxiliary block having a regular dodecagon shape which conforms to the shape of the bulbous portion, without the main portion.

15. The building block system of claim 14, further comprising another auxiliary block shaped as a portion of a dodecagon which has been split along a plane parallel to the axis of the dodecagon.

16. In a building block system which includes a primary building block having a generally rectangular main portion with a pair of vertical sides, a pair of horizontal sides, first and second ends, and a longitudinal axis running through the ends, the primary building block additionally having a bulbous portion connected to the first end of the main portion, the second end of the main portion additionally having a concave socket region to receive a bulbous portion of an adjacent primary building block and one of the horizontal sides of the main portion having at least one projection while the other horizontal side has at least one complementary recess, the improvement wherein:

the outer periphery of the bulbous portion has nine faces that are arranged as three-fourths of the periphery of a regular dodecagon, one of the nine faces being more distant from the main portion of the primary block than the rest of the nine faces and being perpendicular to its longitudinal axis;

the vertical sides of the main portion have recessed faces adjacent the first end, where the main portion merges into the bulbous portion, the recessed faces having the same width as the faces of the bulbous portion and being disposed at a 30° angle relative to the longitudinal axis;

the vertical sides of the main portion have additional recessed faces adjacent the second end, leading to the socket region, the additional recessed faces having the same width as the faces of the bulbous portion and being disposed at a 30° angle relative to the longitudinal axis;

the socket region has a central face which is perpendicular to the longitudinal axis and two side faces, each disposed at a 30° angle with respect to the central face, the faces of the socket region having the same width as the faces of the bulbous portion;

the width of the main portion, taken along a first line which is perpendicular to the vertical sides, is the same as the maximum width of the bulbous portion, taken along a second line which is parallel to the first line; and the building block system further comprises a cover portion with an outline corresponding to that of the main portion of the primary building block, and a cover portion shaped as a regular dodecagon.

17. The building block system of claim 16, further comprising an auxiliary block having a regular dodecagon shape which conforms to the shape of the bulbous portion, without the main portion.

18. The building block system of claim 17, further comprising another auxiliary block shaped as a portion of a dodecagon which has been split along a plane parallel to the axis of the dodecagon.

19. In a building block system which includes a primary building block having a generally rectangular main portion with a pair of vertical sides, a pair of horizontal sides, first and second ends, and a longitudinal axis running through the ends, the primary building block additionally having a bulbous portion connected to the first end of the main portion, the second end of the main portion additionally having a concave socket region to receive a bulbous portion of an adjacent primary building block and one of the horizontal sides of the main portion having at least one projection while the other horizontal side has at least one complementary recess, the improvement wherein:

the outer periphery of the bulbous portion has nine faces that are arranged as three-fourths of the periphery of a regular dodecagon, one of the nine faces being more distant from the main portion of the primary block than the rest of the nine faces and being perpendicular to its longitudinal axis;

the vertical sides of the main portion have recessed faces adjacent the first end, where the main portion merges into the bulbous portion, the recessed faces having the same width as the faces of the bulbous portion and being disposed at a 30° angle relative to the longitudinal axis;

the vertical sides of the main portion have additional recessed faces adjacent the second end, leading to the socket region, the additional recessed faces having the same width as the faces of the bulbous portion and being disposed at a 30° angle relative to the longitudinal axis;

the socket region has a central face which is perpendicular to the longitudinal axis and two side faces, each disposed at a 30° angle with respect to the central face, the faces of the socket region having the same width as the faces of the bulbous portion;

the width of the main portion, taken along a first line which is perpendicular to the vertical sides, is the same as the maximum width of the bulbous portion, taken along a second line which is parallel to the first line; and the building block system further comprises an auxiliary block having a regular dodecagon shape which conforms to the shape of the bulbous portion, without the main portion.

20. The building block system of claim 19, further comprising another auxiliary block shaped as a portion of a dodecagon which has been split along a plane parallel to the axis of the dodecagon.

* * * * *